US005146909A

United States Patent [19]

Ruark et al.

[11] Patent Number: 5,146,909

[45] Date of Patent: Sep. 15, 1992

[54] STATIONARY FINE POINT DIAMOND TRUEING AND DRESSING BLOCK AND METHOD OF USE

[75] Inventors: William W. Ruark, Westerville; Robert L. Henry, Hilliard, both of Ohio

[73] Assignee: The General Electric Company, Columbus, Ohio

[21] Appl. No.: 635,034

[22] Filed: Dec. 28, 1990

[51] Int. Cl.[5] ..... B24B 1/00

[52] U.S. Cl. ..... 125/11.01; 125/36; 51/325

[58] Field of Search ..... 125/36, 38, 39, 11.18, 125/11.01; 51/325

[56] References Cited

U.S. PATENT DOCUMENTS

| | | | |
|---|---|---|---|
| 4,027,648 | 6/1977 | Bonnice | 125/11.01 |
| 4,300,522 | 11/1981 | Henry et al. | 125/39 |
| 4,476,656 | 10/1984 | Bovenkerk | 125/11.01 |
| 4,805,586 | 2/1989 | Borse | 125/39 |

*Primary Examiner*—M. Rachuba
*Attorney, Agent, or Firm*—Mueller and Smith

[57] ABSTRACT

There is provided a tool for trueing and dressing a variety of grinding wheels, comprising a metal block having a thin vertical layer of diamond particles forming a contacting surface. The tool may have a straight edge profile for trueing and dressing Type 1A1 grinding wheels or be fabricated with a non-linear profile for trueing and dressing grinding wheels with complementary profiles. There is also provided a method for trueing and dressing a grinding wheel, by angularly engaging the periphery of a rotating grinding wheel with a stationary trueing and dressing tool having a thin vertical layer of diamond particles. The diamond layer of the tool forms a single point having an effective cutting crossfeed rate relative to the rotational speed of the wheel, the speed at which the wheel is presented to the trueing and dressing block and the angle of said diamond layer within said block relative to the path of travel of the wheel.

7 Claims, 1 Drawing Sheet

STATIONARY FINE POINT DIAMOND TRUEING AND DRESSING BLOCK AND METHOD OF USE

BACKGROUND OF THE INVENTION

The present invention relates to a novel trueing and dressing tool for trueing and dressing a variety of types of grinding wheels and is especially adaptable for use in connection with surface grinding machines. The present invention also relates to a method for trueing and dressing grinding wheels having vitrified-bonded cubic boron nitride (CBN) abrasive using a stationary, fine point trueing and dressing block, mounted in a base in engaging proximity to a traversed, rotating grinding wheel.

A number of grinding wheels are known to those skilled in the art including, for example, conventional aluminum oxide and silicon carbide grinding wheels, resin-bonded and vitrified-bonded CBN grinding wheels, as well as diamond grinding wheels. However, regardless of the type of abrasive employed in the grinding wheel, it is necessary to periodically true and dress the grinding wheel in order to maintain an open and aggressive grinding surface of a known profile. An open and aggressive surface condition on a grinding wheel is generally desirable since an open grinding surface is less likely to burn a workpiece and requires less grinding power than a grinding wheel having closed, or dull surface.

Grinding wheels are applied by wide variety of devices including surface grinding machines. Such a surface grinding device utilizes a wheel mounted on a rotating armature operable in numerous axes to grind a workpiece, typically mounted onto the table of the surface grinder, into a desired shape of a given surface condition. Because a grinding wheel may need to be trued and dressed while a work piece remains mounted on the machine, the space available to mount a trueing and dressing device is limited and becomes a consideration in the type of device chosen.

A variety of methods for trueing and dressing grinding wheels are known in the art; however, each have drawbacks and disadvantages, particularly in regard to trueing and dressing grinding wheels whose abrasive material is diamond or vitrified-bonded CBN which are mounted on surface grinding machines.

One prior art method is disclosed in U.S. Pat. No. 2,791,211 to Nagy and involves periodically indexing a diamond-tip dressing tool in relation to the grinding wheel so that in all indexing positions the diamond is in contact with the wheel in a direction of hard grain, forming an angle of between 30° and 45° to the crystal axis of the diamond. While such a single point diamond tool is effective for dressing conventional grinding wheels made of aluminum oxide or silicon carbide, the diamond tip of such tool is subject to rapid wear and is generally ineffective for use in dressing grinding wheels employing diamond or vitrified-bonded CBN abrasives.

Another prior art method is disclosed in U.S. Pat. No. 4,866,887 to Imai, et al., and involves first trueing the grinding wheel with a nib type trueing tool by making several passes across the grinding wheel at a relatively small infeed rate. In the final traverse feed, after the majority of the crown has been moved from the grinding wheel, the infeed rate of the trueing tool is set at a relatively larger value to form an aggressive cutting edge on the grinding wheel. One disadvantage of this method for trueing and dressing a grinding wheel is the time it takes to complete the number of passes required to true and dress the grinding wheel according to the invention. Perhaps more importantly, however, when such a method is employed to true and dress CBN or diamond grinding wheels, the nib generally suffers from rapid wear and loss of point geometry, thus affecting the trueness of the dressed surface.

A number of alternatives to single point trueing and dressing tools are known in the art and include rotary cup tools and straight wheel tools, using diamond abrasives, such as disclosed in U.S. Pat. No. 4,915,089 to Ruark, et al., which is assigned to the same assignee as the present invention and incorporated by reference into the present disclosure. While such rotary trueing and dressing tools have significantly longer life than single point tools, their wide diamond width is generally ineffective in generating the sharp, aggressive cutting surface on the grinding wheel compared to that produced by single point trueing and dressing tools. Furthermore, rotary trueing and dressing tools may require more wheel head clearance than is available below a grinding wheel in a particular surface grinding application. While the powered rotary dressing tool disclosed in U.S. Pat. No. 4,915,089, overcomes the disadvantage of the wide diamond width by its substitution of a single layer of diamond mounted in an axis perpendicular to the rotational axis of the dressing wheel, the method may still require more space in proximity to the grinding wheel than is available.

Prior art also reveals a large surface, diamond-impregnated, block type trueing and dressing tools designed for stationary use. Such block type devices can mounted, for example, unobtrusively on the table of a surface grinding machine. Periodically, as a grinding wheel needs true and dressed, the wheel can be indexed to the table position where the block is mounted and brought into abrading contact with the block's diamond-impregnated surface. After the trueing and dressing operation is complete, the grinding wheel is indexed into its surface grinding position. Since such block type trueing and dressing tools are stationary, this technology necessarily relies on the positioning controls of the grinding machine, whether manual or programmed, to bring the rotating grinding wheel into abrading contact with the trueing and dressing surface of the block.

While offering the advantages of being smaller, less expensive and simpler to implement than their rotary alternatives, a large surface area diamond-impregnated block, because of its wide band of abrasive, tends to dull and close a grinding wheel and may leave it with a crowned profile, as well. Grinding wheels in such a dull and closed condition are not desirable since they can generate excessive heat during the grinding process, causing the wheel to burn the work piece. Furthermore, a crowned grinding wheel profile generally affords the artisan less control over the profile of the work piece.

While such prior art methods may be employed despite their respective shortcomings, manufacturers are always concerned with improving the efficiency of the trueing and dressing process. Such improvements should include reducing the time required to true and dress a grinding wheel, reducing the costs associated with the trueing and dressing process, and improving the quality of the profile and surface condition of the trued grinding wheel.

SUMMARY OF THE INVENTION

It is an object of the present invention to provide a small, stationary and relatively inexpensive fine point diamond tool for trueing and dressing a variety of grinding wheels, including those containing CBN and diamond abrasives.

It is another object of the present invention to provide a method for trueing and dressing a grinding wheel using a stationary, fine point diamond trueing and dressing tool comprised of at least one block that can be non-obtrusively mounted in abrading proximity to a traversed rotating grinding wheel.

In accordance with one aspect of the present invention, there is provided a grinding wheel trueing and dressing apparatus for trueing and dressing the peripheral surface of a traversed, rotating grinding wheel having a width, when the wheel is presented into abrading contact with the edge of a vertically disposed layer of diamond particles. The apparatus is comprised of at least one polygonal block with sides and having a thin vertical layer of diamond particles forming a contacting surface across the width of an engaging grinding wheel. The apparatus is also comprised of a mounted base for retaining the polygonal block during abrading engagement between the block and the traversed, rotating grinding wheel.

In the preferred embodiment of the invention, the thin layer of diamond is only a single layer of diamond in width and is disposed between the sides of the trueing and dressing block. In a less preferred embodiment, the diamond layer is applied to at least one side of the block.

In accordance with another aspect of the present invention, there is provided a method for trueing and dressing a traversed, rotating grinding wheel having a width, comprising angularly engaging the periphery of said wheel with a trueing and dressing tool having at least one polygonal block with a thin vertical layer of diamond particles forming a contacting surface across the width of the wheel.

The fine point diamond trueing and dressing block disclosed by the present invention provides a fast, inexpensive and efficient method of trueing and dressing grinding wheels. In addition to being provided with straight profiles to true and dress Type 1A1 grinding wheels, blocks may be fabricated with a variety of profiles, such as concave or convex, to effect trueing and dressing on grinding wheels having complementary profiles. In its preferred embodiment, the invention is implemented by mounting the trueing and dressing tool in a fixed location on the grinding table and periodically indexing the grinding wheel into abrading contact with the tool as the wheel becomes dulled or loses its desired profile. However, it is obvious that the invention may be mounted in other orientations allowing for abrading contact with the surface grinding wheel, as well.

The placement of the diamond particles in one aspect of the present invention yields a single point of contact with a grinding wheel, similar to that of a single point nib-type truer and dresser. As a result, the trueing and dressing block of the present invention is very free cutting. However, the life of the tool of the present invention is dramatically increased over that of a conventional single point diamond trueing and dressing tools, since fresh, unworn diamond particles replenish the dulled and depleted diamond layer as the tool wears.

DETAILED DESCRIPTION OF THE INVENTION

There is provided by the present invention a tool for trueing and dressing a grinding wheel, comprising a stationary block having a thin vertical layer of diamond particles forming a contacting surface with the grinding wheel being dressed. While the trueing and dressing tool of the present invention is particularly well-suited for trueing and dressing large diameter vitrified-bonded CBN grinding wheels, it may also be used effectively and efficiently on conventional grinding wheels such as, for example, aluminum oxide and silicon carbide, as well as resin-bonded CBN grinding wheels and diamond grinding wheels.

Figure 1:
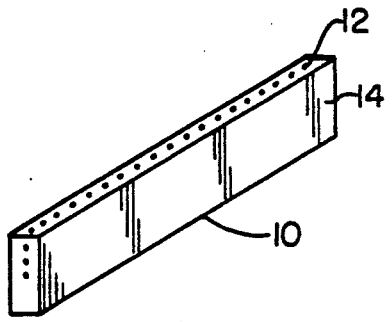
FIG. 1 is a front elevational view depicting the preferred embodiment of the trueing and dressing block in accordance with the present invention.

Referring now to the drawings, FIG. 1 shows a unitary trueing and dressing block 10 as disclosed by the present invention, wherein, in the preferred embodiment, a thin layer of diamond 12 is vertically disposed intermediate and parallel to the sides of block 10. The diamond layer 12 may be applied between sections of suitable bonding material 14 by a variety of methods, including plating, chemical vapor deposition or applied as a separate component on its own substrate. The final compact forming trueing and dressing block 10, may be formed by methods known in the art, including the pressing process disclosed by U.S. Pat. No. 4,915,089. Although not shown, diamond layer 12 is equally effective for trueing and dressing grinding wheels 20 when disposed intermediate, yet not parallel, to the sides of block 10.

Diamond particles of any size may be employed in diamond layer 12, depending upon the trueing and dressing requirements of the abrasive type used in a particular grinding wheel. Preferably, larger size diamond particles, e.g., 20/25 to 30/40 U.S. mesh size, are utilized for trueing and dressing vitrified-bonded CBN grinding wheels, as they provide a longer useful life. However, the present invention may be employed using diamond particles down to 60/80 U.S. mesh size and finer. The artisan will be able to select suitable diamond particle sizes for use in trueing and dressing other types of grinding wheels without undue experimentation.

Figure 2:
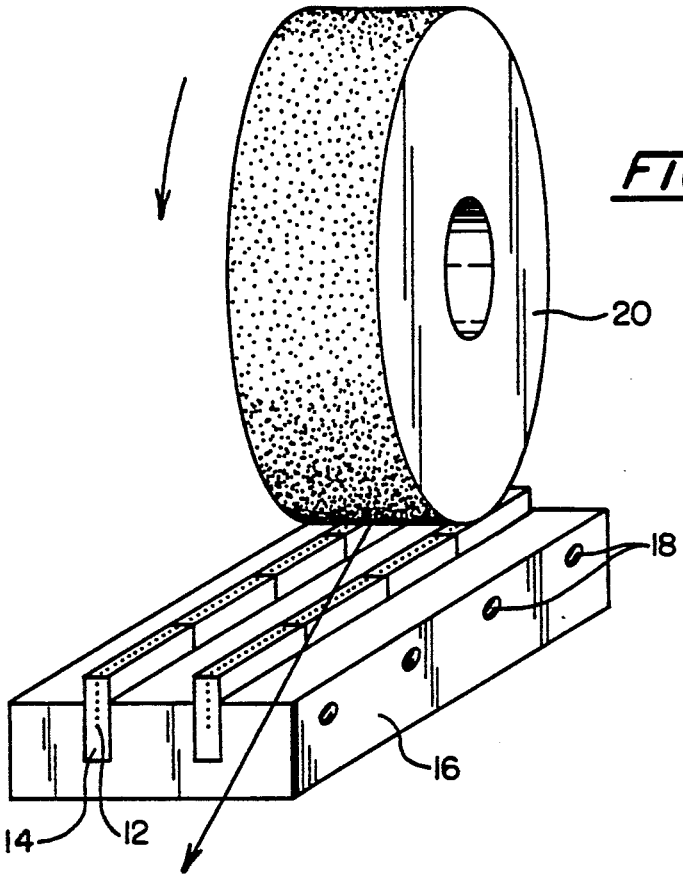
FIG. 2 is a front elevational view depicting a plurality of base-mounted trueing and dressing blocks in accordance with the present invention.
Figure 3:
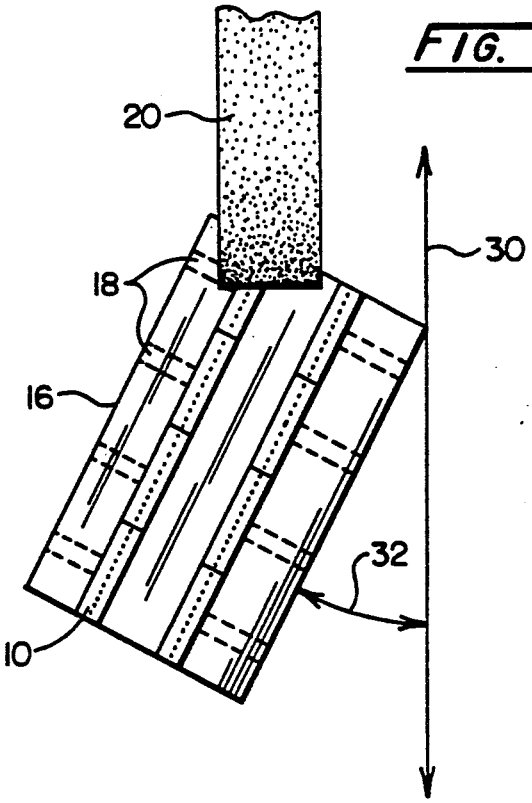
FIG. 3 is a plan view depicting the angular engagement of the grinding wheel with the trueing and dressing blocks in accordance with the present invention.

Body 14 of block 10 may consist of any suitable bonding material, with harder bonding materials, such as those containing iron or cobalt, being the most preferred. In the preferred embodiment, ferrous bonding materials are generally used in body 14 for applications involving the trueing and dressing of resin-bonded, e.g., polyimide-bonded, and vitrified-bonded CBN grinding wheels 20. In the preferred embodiment, trueing and dressing block 10 employs cemented carbide bonding material for body 14 for trueing and dressing grinding wheels 20 containing diamond abrasives. The most important criterion in the selection of a suitable material for body 14, is that the bonding material must be sufficiently hard to retain the diamond layer 12 in the trueing and dressing block. While the trueing and dressing block 10 is shown in FIG. 1 as composed of a unitary construction, the invention also embraces a plurality of shorter trueing and dressing blocks 10 mounted in end to end abutment, as shown in FIGS. 2 and 3. Also, the preferred embodiment of the present invention has diamond layer 12 disposed intermediate the sides of block 10. However, the invention also encompasses polygonal trueing and dressing blocks 10 wherein the diamond layer 12 is attached to at least one side of block 10.

Again referring to FIGS. 2 and 3, trueing and dressing blocks 10 are secured into base 16 by a plurality of set-screws 18. With the blocks 10 securely in place, base 16 is typically mounted to the table of a surface grinding machine (not shown) at such an angle 32, that the entire width of engaging grinding wheel 20 comes into abrasive contact with diamond layer 12 of one or more trueing and dressing blocks 10 as rotating grinding wheel traverses path 30. Although shown with dual strings of trueing and dressing blocks 10 parallelly mounted within base 16, the present invention encompasses any number of blocks 10 mounted in base 16, of sufficient length to contact the entire width of rotating grinding wheel 20 as it traverses path 30.

Trueing and dressing is effected by engaging the periphery of a traversed, rotating grinding wheel 20 with stationary trueing and dressing block 10, generally secured by mounted base 16. Power for the trueing and dressing operation is supplied by the rotation of the grinding wheel 20 being dressed. When employed by a surface grinding machine, the invention employs the powered table and feed controls of the surface grinding machine (not shown) to bring rotating grinding wheel 20, traveling along path 30, into abrading contact with diamond layer 12 of trueing and dressing block 10, as depicted in FIG. 3. There it can be seen that a rotating grinding wheel 10 passing over one or more trueing and dressing blocks 10, mounted at angle 32, would cause the entire width of grinding wheel 20 to come into contact with diamond layer 12. For any given wheel, the proper mounting angle 32 of base 16 will be determined by the outer limits of the diamond layer 12. As wheel 20 passes along the surface of dressing block 10, diamond layer 12 imparts the desirable wear condition achieved by a rotary-powered diamond dresser without the rotary dresser's cost and space disadvantages. Grinding wheel 20 and trueing and dressing blocks 10 are repeatedly brought into abrading contact until the peripheral surface of grinding wheel 20 is opened and the desired grinding wheel profile is achieved. The desired aggressiveness of the grinding wheel 20 surface condition is controlled by increasing or decreasing the trueing and dressing rate, i.e., adjusting the dressing downfeed rate; adjusting the r.p.m. of rotating grinding wheel 20; or adjusting the rate of the travel of traversed grinding wheel 20 along path 32. A lateral crossfeed may be desirable in a straight dressing operation to maintain a flat and uniform surface on truing and dressing block 10 or to compensate for variations in width of grinding wheel 20. Both the dressing rate and the number of dressing passes are operational parameters the artisan will be able to determine without undue experimentation.

We claim:

1. A method for trueing and dressing a grinding wheel having a a peripheral surface and a rotational axis comprising:

providing a stationary trueing and dressing tool with at least one polygonal block having an upper surface, sides and a vertically-disposed thin, generally planar layer of diamond particles having an exposed edge on said upper surface of said block;

rotating said grinding wheel about said rotational axis;

engaging said peripheral surface of the rotating grinding wheel with said exposed edge of the diamond layer; and traversing said grinding wheel along a linear path forming an oblique angle with said exposed edge of the diamond layer effective to dress and true said wheel across said peripheral surface.

2. The method of claim 1, wherein said layer of diamond particles is a single diamond in width.

3. The method of claim 1, wherein said layer of diamond particles range up to about 0.8 mm in width.

4. The method of claim 1, wherein the size of the diamond particles in said layer is from about 0.17 millimeters to about 0.8 millimeters.

5. The method of claim 1, wherein said layer of diamonds is attached to at least one side of said block.

6. The method of claim 1, wherein said layer is affixed to said block by plating, metal bonding, or chemical vapor deposition.

7. The method of claim 1, wherein the layer of diamond particles is disposed intermediate said sides of said block.

* * * * *